US006962099B2

(12) United States Patent
Slepekis

(10) Patent No.: US 6,962,099 B2
(45) Date of Patent: Nov. 8, 2005

(54) OPEN-END ADJUSTABLE RATCHETING WRENCH

(76) Inventor: Patrick Jon Slepekis, 4570 Ridge Crest Rd., Sturgeon Bay, WI (US) 54235

( * ) Notice: Subject to any disclaimer, the term of this patent is extended or adjusted under 35 U.S.C. 154(b) by 0 days.

(21) Appl. No.: 10/654,190

(22) Filed: Sep. 3, 2003

(65) Prior Publication Data

US 2005/0044999 A1 Mar. 3, 2005

(51) Int. Cl.[7] ..... B25B 13/16
(52) U.S. Cl. ..... 81/157; 81/126; 81/165
(58) Field of Search ..... 81/126–176

(56) References Cited

U.S. PATENT DOCUMENTS

| | | | | | |
|---|---|---|---|---|---|
| 2,232,259 | A | * | 2/1941 | Morgan | 81/126 |
| 2,562,060 | A | * | 7/1951 | Pehrsson | 81/126 |
| 2,596,266 | A | * | 5/1952 | McEnroe , Jr. | 81/165 |
| 3,407,689 | A | * | 10/1968 | Slayton | 81/134 |
| 3,916,735 | A | * | 11/1975 | Evans | 81/165 |
| 4,324,159 | A | | 4/1982 | Wrobbel | |
| 4,548,104 | A | | 10/1985 | Hendricks | |
| 4,706,528 | A | | 11/1987 | Inoue | |
| 4,838,132 | A | | 6/1989 | Pyles | |
| 4,903,556 | A | | 2/1990 | Spirov et al. | |
| 4,924,735 | A | * | 5/1990 | Lee | 81/133 |
| 5,050,464 | A | | 9/1991 | Hurtig | |
| 5,297,459 | A | | 3/1994 | Stojanowski | |
| 5,595,098 | A | | 1/1997 | Malkin et al. | |
| 5,941,142 | A | | 8/1999 | Janson | |
| 6,016,723 | A | | 1/2000 | Hillinger | |
| D427,033 | S | * | 6/2000 | Wilkinson | D8/22 |
| 6,418,819 | B1 | * | 7/2002 | Kuo | 81/165 |

* cited by examiner

*Primary Examiner*—Hadi Shakeri
(74) *Attorney, Agent, or Firm*—Jansson, Shupe, Munger & Antaramian, Ltd.

(57) ABSTRACT

A side-entry, adjustable, ratcheting wrench has a first jaw member having an interior portion, a second jaw member slidingly engaged with the first jaw member, a spool disposed in the interior portion of the first jaw member, the spool having a worm gear along a first lengthwise outer portion and a series of concentric grooves along a second lengthwise outer portion, the worm gear for adjustment of the second jaw member, and a handle having a series of first projections engaged with the concentric grooves when the wrench is at a working position and disengaged from the concentric grooves when the wrench is at a ratcheting position.

27 Claims, 13 Drawing Sheets

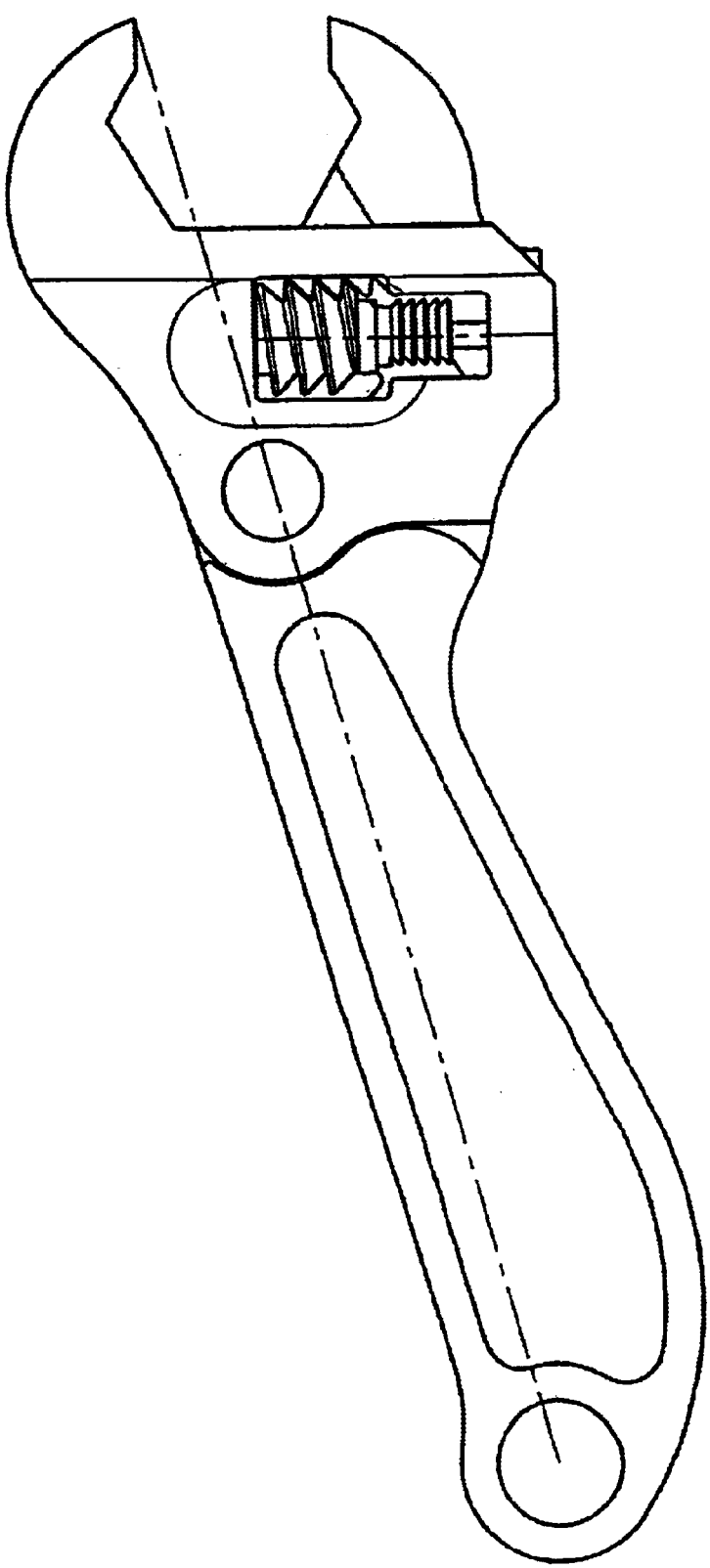
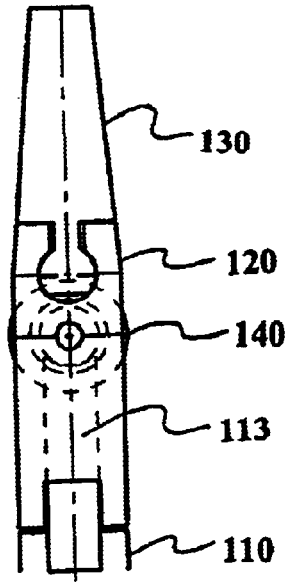
FIG. 14B
FIG. 14A

OPEN-END ADJUSTABLE RATCHETING WRENCH

BACKGROUND

1. Field of the Invention

The present invention relates to hand tools and associated fastening devices and, more particularly, to an improved open-end adjustable wrench as well as a system and method for conveniently, effectively, and with improved safety, loosening or tightening a bolt or like article having a polygonal head.

2. Background of the Invention

Many types of adjustable wrenches are well known in the art. For example, a crescent type wrench typically has an open-end, adjustable, parallel jaw configuration where the jaws are fit onto a bolt or a nut by means of a worm gear that drives a series of teeth formed integrally with a moveable jaw. By such an adjusting, a bolt or nut is secured between the moveable jaw and a stationary jaw.

Open-end adjustable jaw wrenches may have a limited function in a tight work space if the bolt or nut can only be rotated a fraction of a turn before it is necessary to remove the wrench from the bolt or nut and reposition the wrench for a subsequent fractional turn. A ratcheting mechanism may be combined with an open-end adjustable jaw wrench, but conventionally there have been problems due to inefficient use of applied torque. In addition, under high torque loads it is very common for a conventional wrench to slip sideways off of the bolt head, frequently resulting in physical injury to the user of the tool.

OBJECTS OF THE INVENTION

It is an object of the invention to provide an improved open-end adjustable wrench by overcoming some of the problems and shortcomings of the prior art, including those referred to above.

Another object of the invention is to provide a system of an open-end adjustable wrench and a bolt or nut where the system effects an improved transmittance of torque during tightening.

Another object of the invention is to provide an open-end adjustable wrench for side-mounting a target bolt or nut and then applying a force to the wrench in either a working direction or a ratcheting direction.

Still another object of the invention is to provide a side-entry, adjustable ratcheting wrench assembly which can be used to conveniently, effectively, and with improved safety, loosen or tighten a bolt or like article having a polygonal head.

Yet another object of the invention is to provide a wrench design adaptable to being used to rotate a dodecagonal head, and/or heads having a hexagonal or square configuration, in a difficult to access location with limited space in the arc of action or little clearance above the bolt.

Another object of the invention is to provide an open-end, adjustable, ratcheting wrench assembly that transmits substantially all of the input force as a torque force and not a clamping force.

A further object of the invention is to provide an open-end, adjustable, ratcheting wrench assembly where the fit of a polygonal head bolt into the jaws of the wrench makes it nearly impossible for the tool to slide sideways off of the head, even under very high torque application.

A still further object of the present invention is to provide a side-entry, adjustable ratcheting wrench assembly which can be continuously ratcheted through small degrees of operational arc.

How these and other objects are accomplished will become apparent from the following descriptions and the drawings.

SUMMARY OF THE INVENTION

The present invention is directed to a side-entry, adjustable ratcheting wrench assembly that provides a series of improvements and changes to conventional apparatus known as "crescent" wrenches and similar side-entry adjustable wrenches. The improvements provide labor saving and time saving ratcheting type mechanisms for manipulating bolts between two opposing jaws of the wrench. For example, under high torque loads the wrench is resistant to slipping sideways off of a bolt head, thereby preventing physical injury to the user of the tool.

According to an aspect of the invention, a side-entry, adjustable, ratcheting wrench includes a first jaw member having an interior portion, a second jaw member slidingly engaged with the first jaw member, a spool disposed in the interior portion of the first jaw member, the spool having a worm gear along a first lengthwise outer portion and a series of concentric grooves along a second lengthwise outer portion, the worm gear for adjustment of the second jaw member, and a handle having a series of first projections engaged with the concentric grooves when the wrench is at a working position and disengaged from the concentric grooves when the wrench is at a ratcheting position.

A wrench according to the invention may include a pivot connecting the first jaw member and the handle for pivoting between the working position and the ratcheting position. The second jaw member may include a series of second projections engaged with the worm gear such that either of a lateral movement of the worm gear and a rotation of the worm gear causes a corresponding lateral movement of the second jaw member. The first jaw member may include a lateral guide slot for guiding a lateral movement of the second jaw member. The first and second jaw members may have opposing work surfaces that mirror one another, each of the work surfaces including two faces forming a V-shaped notch. The V-shaped notches may each constitute a dihedral angle having an angular amount equal to 180 degrees minus the quantity 360 degrees divided by the number of circumferential surfaces of a polygonal bolt head to be secured by the wrench. In a preferred embodiment the V-shaped notches each constitute a dihedral angle of about one hundred fifty degrees. Such a wrench may be used for securing a dodecagonal head.

In various applications and embodiments, the second jaw member may further include a pull bar for assisting a user in disengaging the spool from the handle. The wrench may further include a rod for securing the spool to the first jaw member, wherein the spool is slidable along the rod. In addition, the wrench may include an urging member for urging the spool to a position for mating of the concentric grooves with the first projections. The urging member may have an adjustment mechanism for changing a force of the urging. The urging member may include a spring member.

In a preferred embodiment, the handle includes a tab extending laterally from the first projections in a direction towards the worm gear, and the spool includes an annular groove disposed along the second lengthwise outer portion and having an open end facing the plurality of first projections. Such a tab and annular groove may be structured so that engagement of the tab with the annular groove prevents disengagement of the concentric grooves from the first projections. In a case where the wrench includes a pivot connecting the first jaw member and the handle for pivoting between the working position and the ratcheting position, the tab and annular groove may be structured so that engagement of the tab with the annular groove prevents the first jaw member from pivoting away from the handle when the worm gear is being tightened while the wrench is in the working position.

In various applications and embodiments, the wrench may be structured so that, between the working position and the ratcheting position, one end of the first jaw member is pivotable away from one end of the handle by a predetermined angular amount. In a preferred embodiment, the predetermined angular amount is merely sufficient to allow the disengagement of the concentric grooves from the first projections.

In various applications and embodiments, the handle may include a center portion formed at a distal end of the handle, the center portion being defined by at least one shoulder formed laterally across the handle, the shoulder having a portion with a radial curve and an other portion, the center portion including a first pivot hole disposed in a center of the radial curve, and wherein the first projections are formed in a distal end of the center portion. The first jaw member may have a first guide slot for receiving the center portion of the handle, a bottom surface with a shape aligned to a shape of the shoulder, a second pivot hole for being aligned with the first pivot hole, a first jaw surface with a first face and a second face, and a second guide slot disposed at least partly along an upper surface of the first jaw member. The second jaw member may have a second jaw surface with a third face and a fourth face that mirror the first and second faces of the first jaw surface, a bottom surface having a plurality of teeth formed therein, and a laterally extended portion for being slidingly disposed in the second guide slot. The wrench may further include a pin disposed in the first and second pivot holes, where the worm gear engages the teeth of the second jaw member, the wrench is structured so that lateral movement of the worm gear moves the second jaw member by engagement of the teeth, the first jaw member is pivotable a predetermined angular amount away from the other portion of the shoulder when a force is applied to the handle in a ratchet direction, and where the first jaw member is pivotable to abut the other portion of the shoulder when a force is applied to the handle in a work direction. The wrench may include a spring member structured to urge the spool to return to a position for mating the concentric grooves with the first projections. Such a spring member may be disposed in the spool and include a rod and a spring disposed about the rod, so that the spool is slidable along the rod when disengaged from the first projections. The spring member may include an adjustment mechanism for changing an urging force of the spring member. The first jaw surface may have a fifth face, and the second jaw surface may have a sixth face that mirrors the fifth face. In a preferred embodiment, the fifth and sixth faces are each oriented normal to the second guide slot and are proximate an open end of the wrench.

The wrench design may be adapted to accommodate different types of fastener heads. Therefore, a first dihedral angle is formed between the first and second faces, a second dihedral angle is formed between the third and fourth faces, and the first and second dihedral angles each have an angular amount equal to 180 degrees minus a quantity 360 degrees divided by the number of circumferential surfaces of a polygonal bolt head to be secured by the wrench.

According to another aspect of the present invention, a system includes either a dodecagonal-head bolt or a dodecagonal nut, and a side-entry, adjustable, ratcheting wrench having two opposed jaws each having faces with respective dihedral angles of approximately one hundred fifty degrees. In a preferred embodiment, the dodecagonal-head bolt has a width between opposite flat surfaces of about 0.9375 inches and a width between opposite corners of about 0.9706 inches.

According to a further embodiment of the present invention, a method includes providing a side-entry, adjustable, ratcheting wrench having a handle with projections, a first jaw member, a second jaw member, and a spool having a worm gear along a first lengthwise outer portion and a series of concentric grooves along a second lengthwise outer portion, the first jaw member carrying the second jaw member and spool and being pivotable between a first and second angular position, the second jaw member being moveable laterally with a rotation of the worm gear, the concentric grooves being engageable with the projections, the first and second jaw members each having V-notches that oppose one another, turning the worm gear to bring the two V-notches into nested contact with a polygonal-head object, applying force to the handle in a work direction to rotate the polygonal-head object in the work direction until a predetermined arc for the handle is exhausted, applying force to the handle in a direction opposite the work direction until the handle pivots from the first angular position to the second angular position, thereby disengaging the worm gear from the handle, pushing one of the worm gear and the second jaw member laterally, thereby carrying the second jaw member away from the-first jaw member, and applying additional force to the handle in the direction opposite the work direction.

According to an additional aspect of the invention, a method includes providing a side-entry, adjustable, ratcheting wrench having a handle with projections, a first jaw member, a second jaw member, and a spool having a worm gear along a first lengthwise outer portion and a series of concentric grooves along a second lengthwise outer portion, the first jaw member carrying the second jaw member and spool and being pivotable between a first and second angular position, the second jaw member being moveable laterally with a rotation of the worm gear, the concentric grooves being alignable with the projections, the first and second jaw members each having V-notches that oppose one another, turning the worm gear to bring the two V-notches into nested contact with a polygonal-head object, applying force to the handle in a work direction to rotate the polygonal-head object in the work direction until an available arc for the handle is exhausted, applying force to the handle in a ratcheting direction opposite the work direction until the handle pivots from the first angular position to the second angular position, thereby disengaging the worm gear from the handle, and applying additional force to the handle in the ratcheting direction. In a preferred embodiment, the method also includes adjusting an urging force of the spring member against the worm gear to thereby adjust a resistance of the second jaw member to movement of the handle in a ratcheting direction.

The foregoing summary is intended to be non-limiting since the invention is only defined by the appended claims.

BRIEF DESCRIPTION OF THE DRAWING FIGURES

Figure 11B:
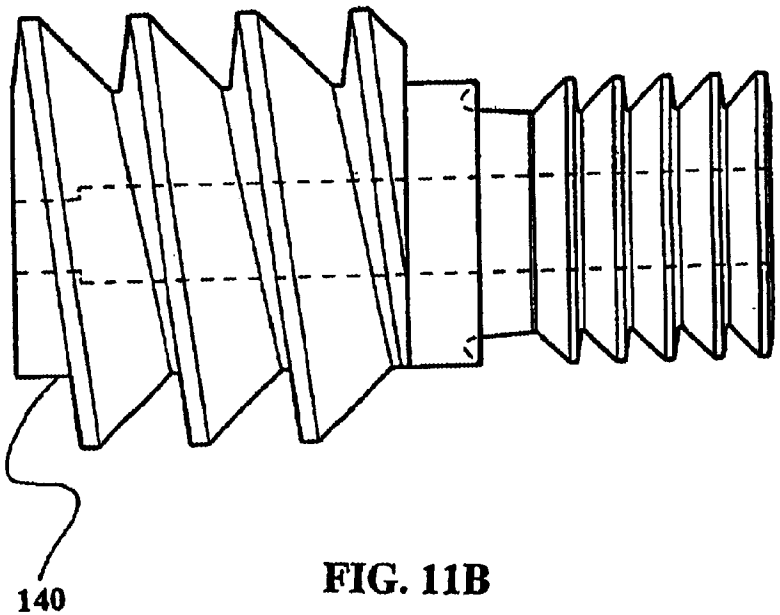
Figure 11A:
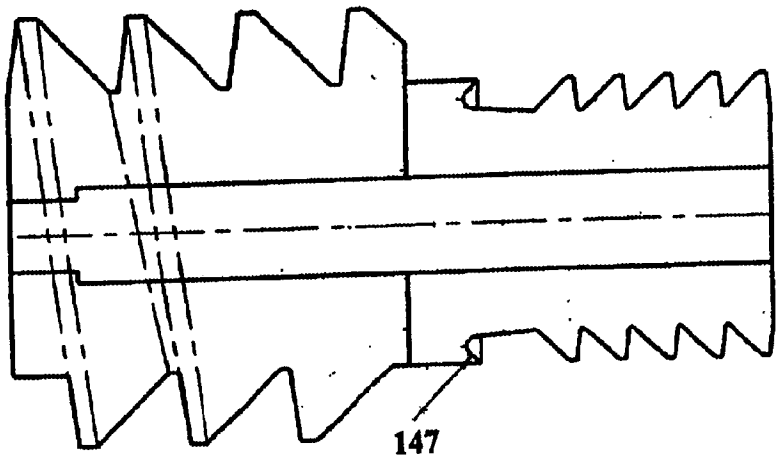

FIGS. 11A–B show a groove added to the worm gear spool in order to prevent the consecutive grooves of the worm gear from disengaging from the handle during use of the wrench, in an exemplary embodiment of the present invention.

Figure 8:
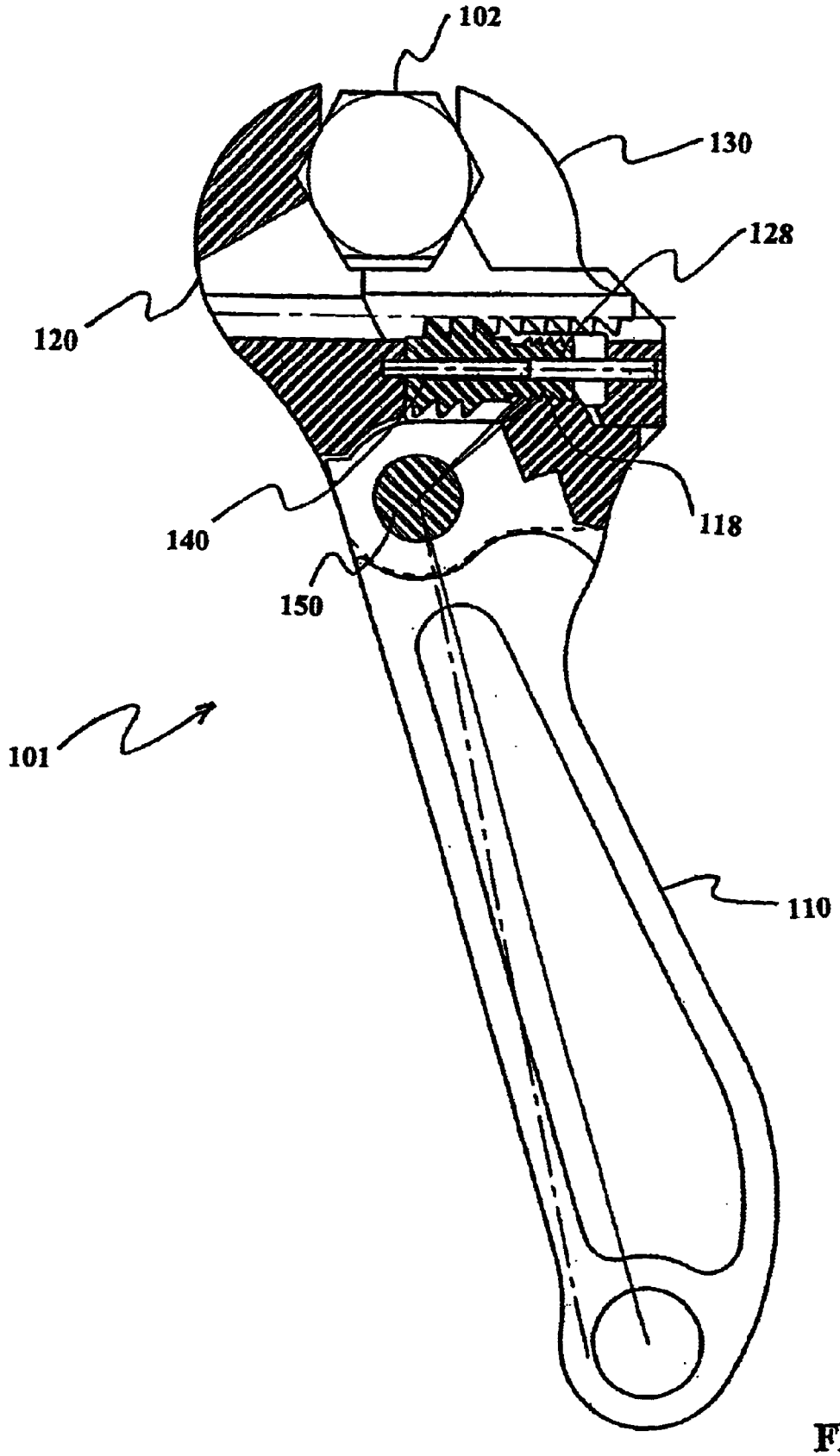
FIG. 8 is a face view of a wrench according to another exemplary embodiment of the present invention, the view of the wrench showing a main tool body, a worm gear, and a pivot pin cross-sectioned, and showing the handle partially cross-sectioned, where a hexagonal bolt is secured in the wrench jaws and teeth of the handle are engaged with consecutive grooves of the worm gear.
Figures 9A, 9B:
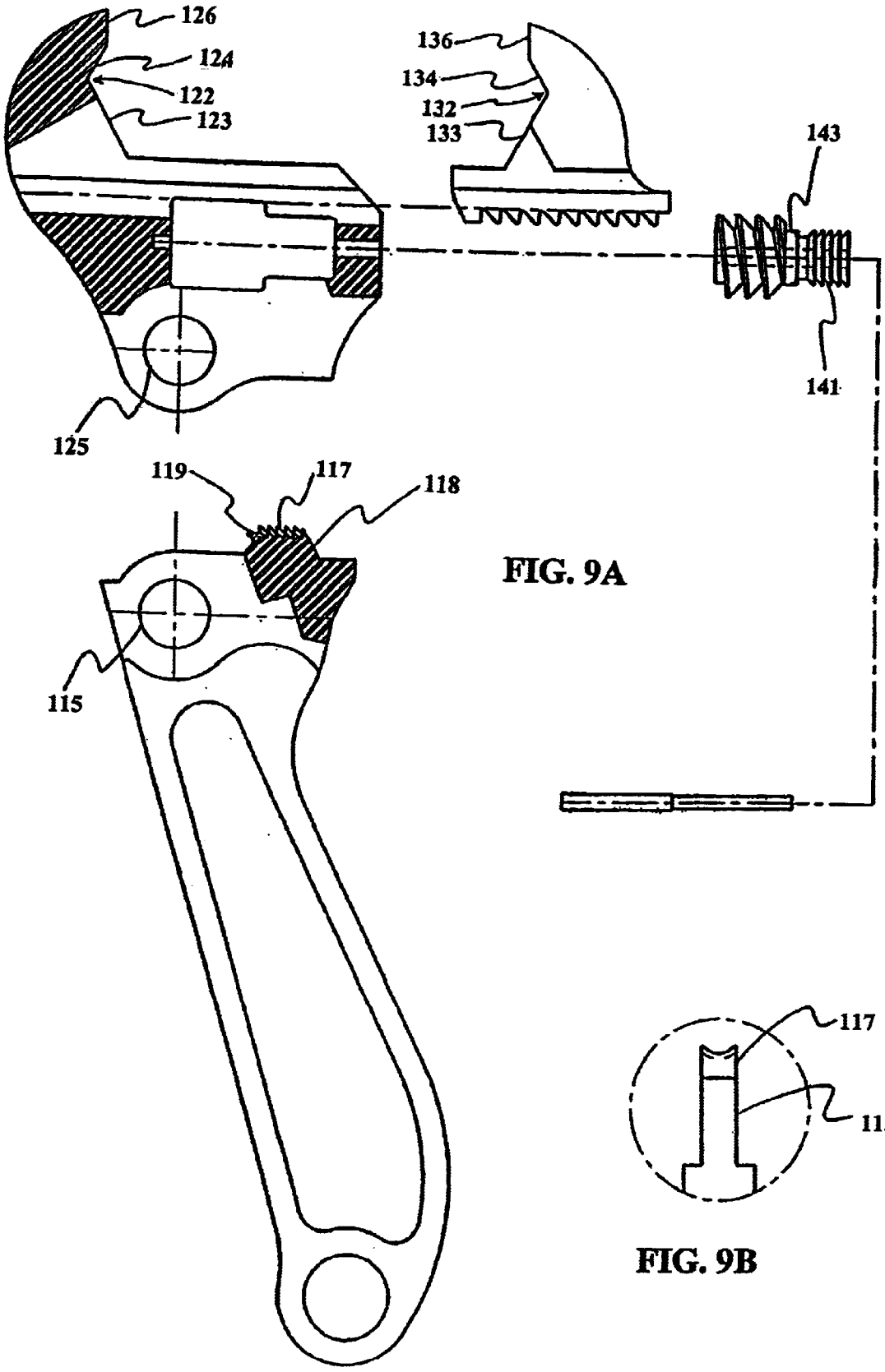
FIG. 9A is an exploded view of the side-entry, adjustable ratcheting wrench assembly of FIG. 8, some parts being shown as cross-sectioned or as partially cross-sectioned
FIG 9B is a fragmentary enlarged view of a teeth section of the handle of the wrench assembly.
Figure 12:
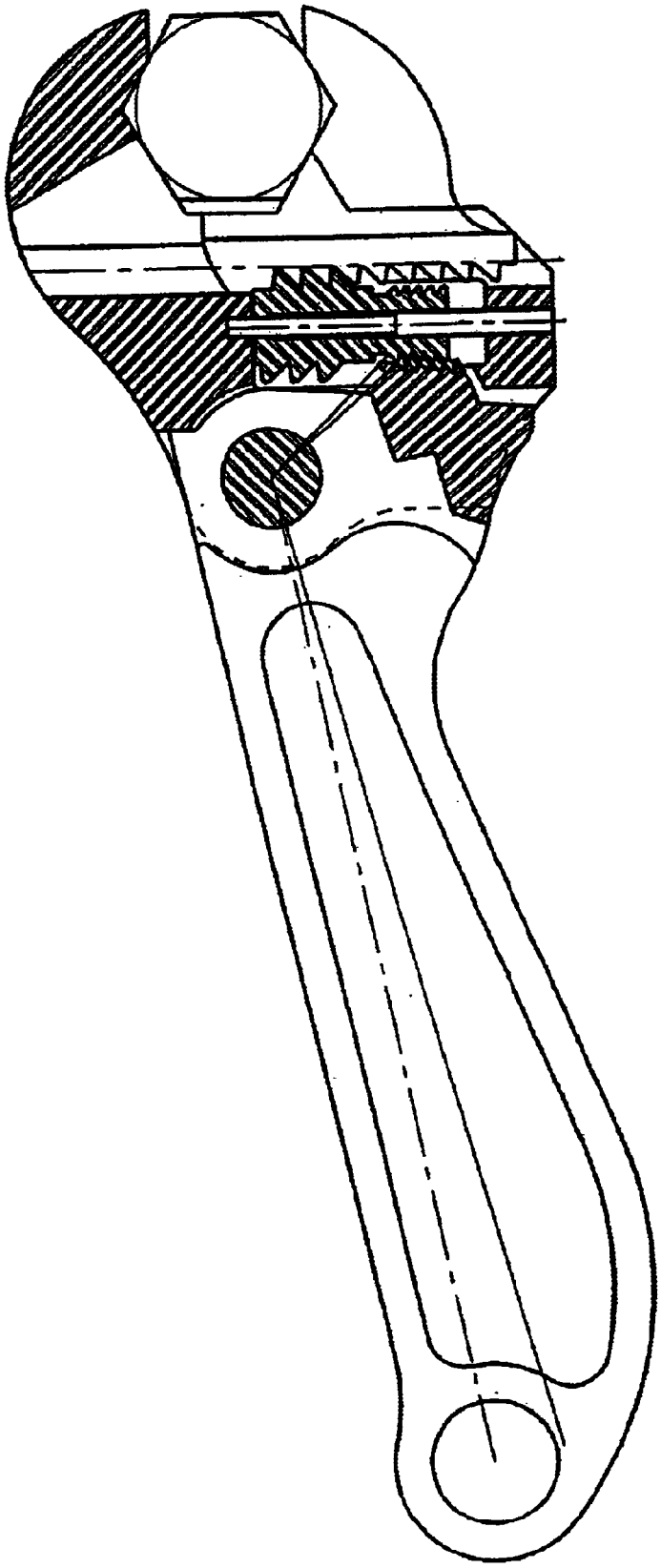

FIG. 12 is a face view of the wrench of FIG. 8, showing a hexagonal bolt being secured in the jaws, where the handle has been rotated clock wise 4 degrees to disengage the consecutive grooves of the worm gear from the teeth of the handle.

Figure 13:
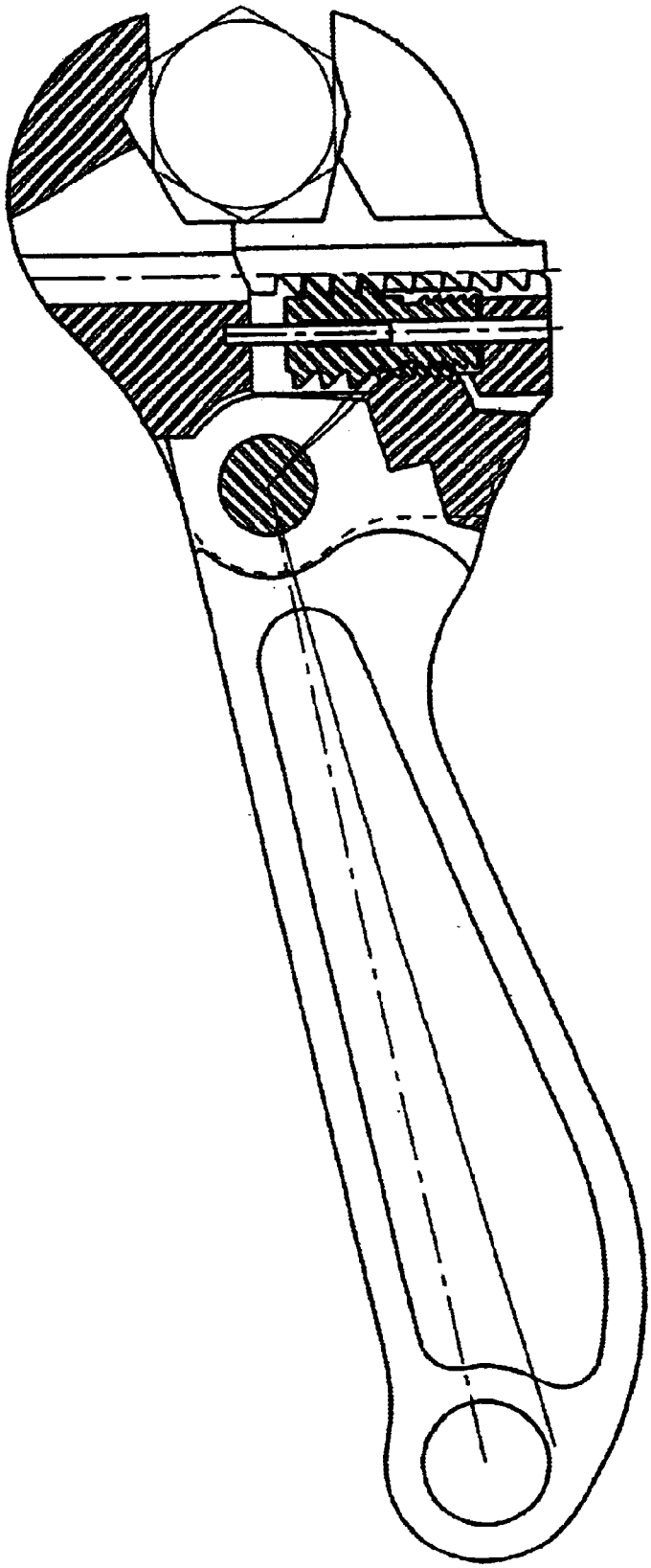

FIG. 13 is a face view of the wrench of FIG. 8, showing the teeth of the handle disengaged from the consecutive grooves of the worm gear, and the wrench assembly rotated 30 degrees around a hexagonal head bolt which has not moved, where the dynamic jaw has been forced to open further, carrying the worm gear back on its axis pin.

FIGS. 14A–B show a front view and an end view of the wrench assembly of FIG. 8, the end view in FIG. 14B illustrating how the upper section of the handle is engaged with the worm gear.

DETAILED DESCRIPTION OF PREFERRED EMBODIMENTS

FIGS. 1–5 show an embodiment of a side-entry, adjustable ratcheting wrench assembly. The wrench 1 includes a handle 10, a main tool body 20 that acts as a pivoting stationary jaw, a dynamic jaw 30, a spring-loaded worm gear 40, and a pivot pin 50.

The handle 10 has a shoulder 11 extending laterally in a width-wise direction, generally, on both the front and back sides of the handle so that the upper portion of the handle 10 is offset from both the front and back outer surfaces of the handle 10. The handle 10 has a pivot hole 15 that aligns with the pivot hole 25 of the main tool body 20 so that the pivot pin 50 connects the main body 20 to the handle 10 and allows the handle 10 to pivot in relation to the main tool body 20. The shoulder 11 has at least one portion 12 with an arc shape formed radially with respect to the pivot holes 15, 25. The shoulder 11 may have a different shape or a same shape respectively on the front and back surfaces of the handle 10. A series of buttress-thread profile teeth 17 is formed on an uppermost surface of the handle 10. As shown in the sideview teeth profile of FIG. 2A, the teeth 17 are formed in an upper portion 13 of the handle 10 located above the shoulders 11. The teeth 17 may have upper portions with an indented profile, as shown, or may have a flat upper surface. An indented profile may allow more surface contact between the teeth 17 and the grooves 41. The upper portion 13 having the series of buttress-thread profile teeth 17 forms an extension 18 roughly perpendicular to the length of the handle 10. This extension 18 fits into a slot (not shown) in the main tool body 20. The teeth 17 will either mesh with, or disengage from, a series of matching, consecutive grooves 41 formed as an addition to the modified worm gear 40, depending on the direction that the handle 10 is pivoted on the main body 20.

The main tool body 20 serves as a stationary jaw into which is installed the dynamic jaw 30, the modified worm gear 40, the modified worm gear's axis pin 60 and pre-load compression spring 61, and the pivoting handle 10 by way of a cross pin 50 or rivet through the main tool body 20, loaded in double shear. Into the face of the stationary jaw 20 is formed a "V" notch 22 having a dihedral angle of, in the preferred embodiment, 150 degrees, with either face 23, 24 of the "V" notch 22 forming an angle of 15 degrees to the main face of the jaw. A face 26 is formed at the bolt-entry end of the stationary jaw 20. The main tool body 20 has an interior cut-out section 27 that allows a user to access the worm gear 40 for adjusting the distance between the jaws 20, 30. The interior section 27 has a bore on its lateral ends so that a pin 60 may be inserted through the worm gear 40 for holding the worm gear 40 to the tool body 20.

The dynamic jaw 30 is loaded into the keyway 29 of the main tool body 20, and its distance from the stationary jaw is controlled by the worm gear 40. The face of the dynamic jaw 30 is also formed a "V" notch 32. In the preferred embodiment the "V" notch 32 in the dynamic jaw is a mirrored image of the "V" notch 22 in the stationary jaw. Therefore, the V notch 32 having a dihedral angle of 150 degrees is formed from faces 33, 34. A face 36 is formed at the bolt-entry end of the dynamic jaw 30. The bottom of the dynamic jaw 30 has a section of consecutive projections 39 that maintain a constant pitch.

The worm 40 for adjusting the distance between the jaws 20, 30 is axially longer than conventional apparatus. The additional length of the worm 40 is a dowel-like extension, into the outside diameter of which is formed a series of consecutive grooves 41 having a buttress thread profile to match a profile of the teeth 17 formed in the upper surface of the previously described handle 10 (in this example, an outer radius R of the worm gear collar and teeth sections is 0.188 inches). The grooves 41 are preferably formed concentrically so that the rotation of the worm 40 when the worm 40 is engaged with the handle 10 allows the dynamic jaw 30 to be moved laterally without changing the lateral position of the worm 40. This configuration also provides a smoother movement of the worm 40 and a better distribution of torque being applied to the worm 40. A compression spring 61 is set into the axial bore 42 of the modified worm 40 and is constrained by a shoulder within the axial bore 42. The modified worm 40 with its pre-load compression spring 61 is constrained in an internal cavity of the main tool body 20 by an axis pin 60. A compression spring may be a conventional coil spring that is fit around the axis pin 60, the spring may be formed abutting an end of the worm 40, the spring may be formed internally of the pin 60, such as in a conventional "pogo" type structure, or other spring forms may be used. The axis pin 60 is held in the main tool body 20 by a set screw 65 located in a bore 28 formed laterally in the main tool body 20. The set screw 65 may be an allen type screw or similar, and/or may be formed to allow the user to adjust an amount of urging force of the spring so that a ratcheting action may be optimized by the user for a particular application. A release button (not shown) may be provided so that a user may reset or release a spring tension, either by changing the position of die spring member itself, or by lifting the worm 40 in order to disengage the worm 40 from the threads 17 of the handle 10. The worm 40 has a worm thread section 49 having threads with a pitch that is the same as the pitch of the projections 39 of the dynamic jaw 30. The worm thread 49 is always engaged with the projections 39 so that the dynamic jaw 30 is carried by movement of the worm 40, both by rotation of the worm threads 49 and by a lateral movement of the worm 40 when the worm 40 is free to move laterally against the spring force when the worm 40 is in a ratcheting position.

Figure 1:
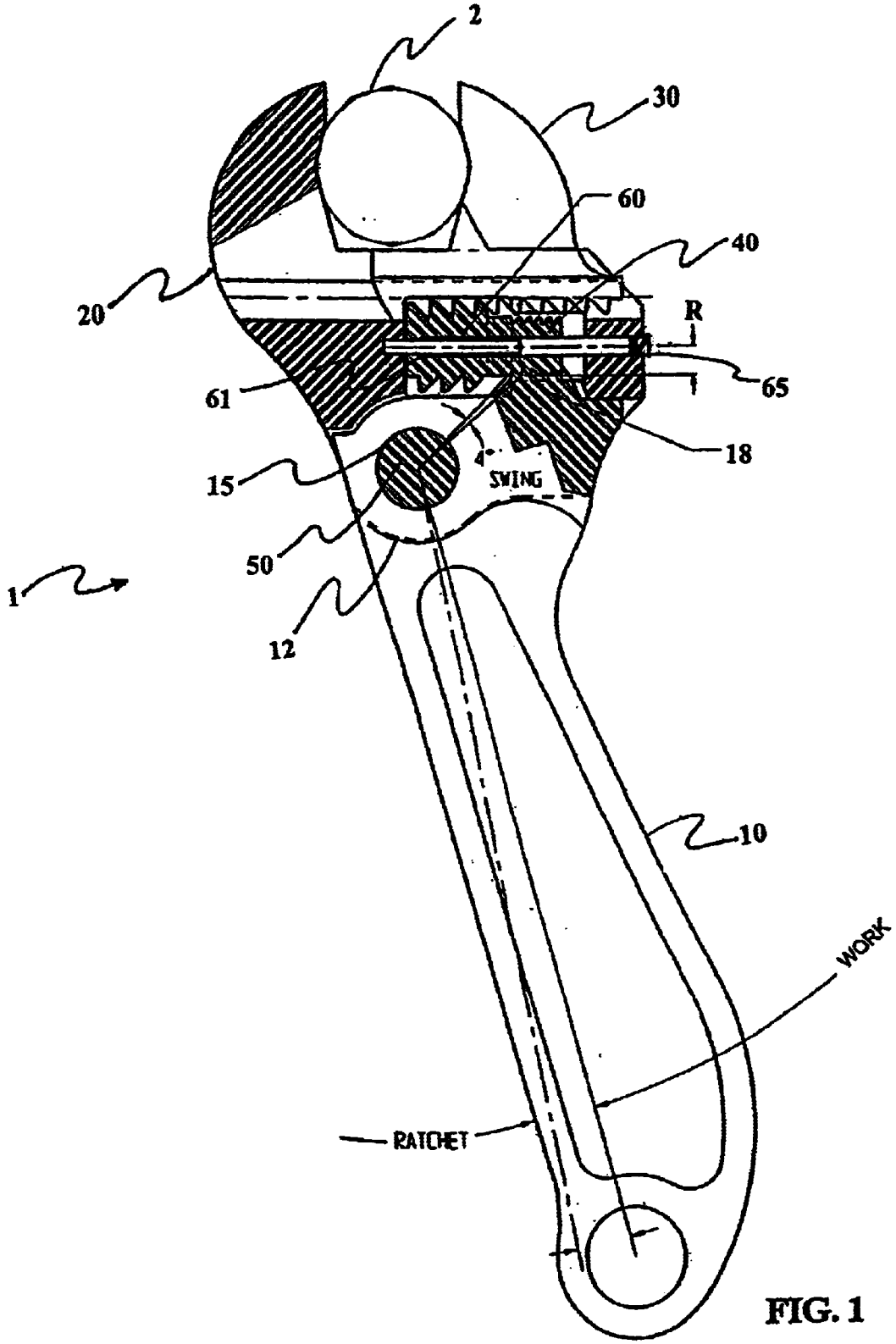
FIG. 1 is a face view of a wrench according to an exemplary embodiment of the present invention, the view of the wrench showing a main tool body, a worm gear, and a pivot pin cross-sectioned, and showing the handle partially cross-sectioned, where a dodecagonal bolt is secured in the wrench jaws and teeth of the handle are engaged with consecutive grooves of the worm gear.
Figures 2A, 2B:
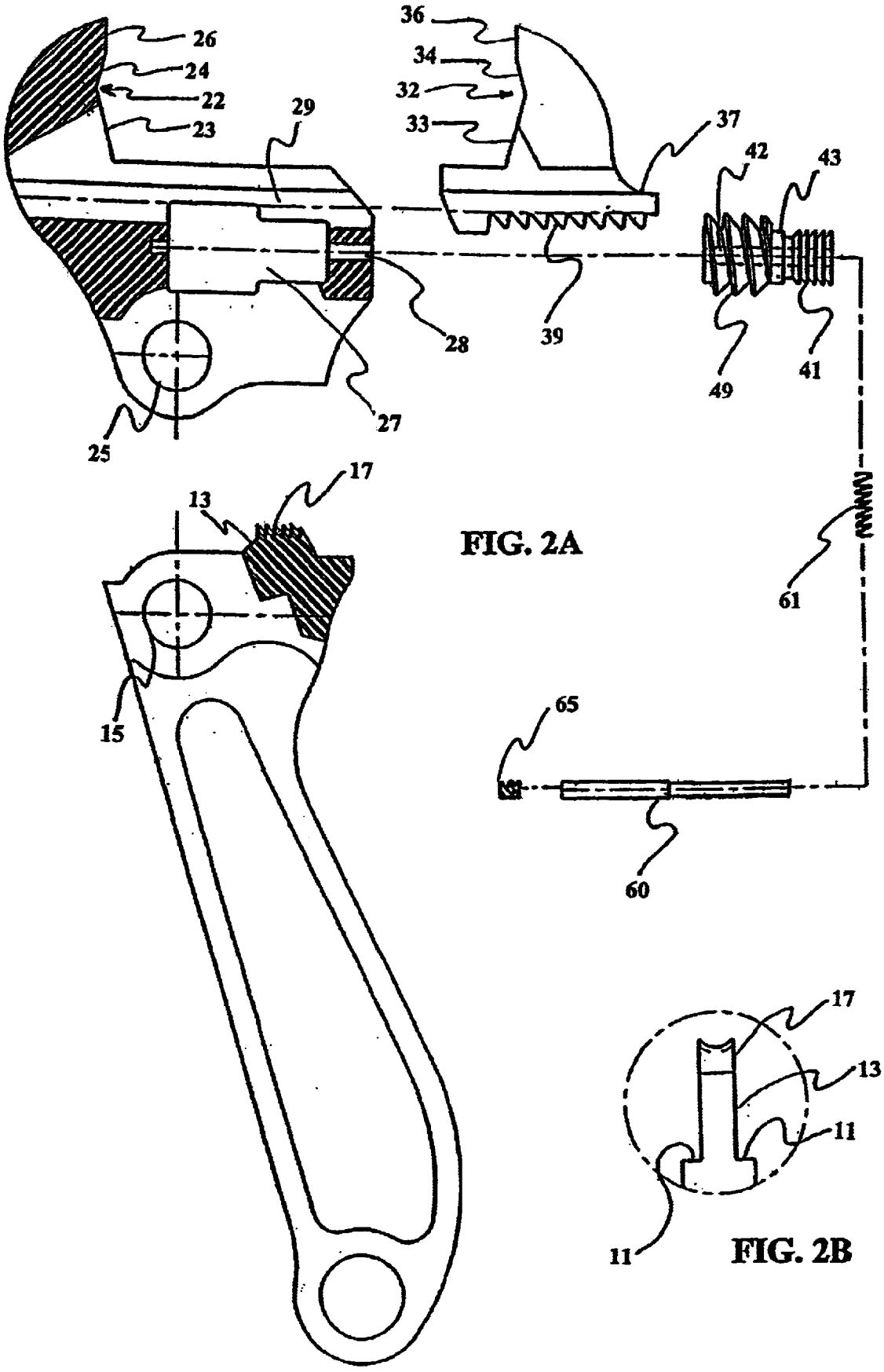
FIG. 2A is an exploded view of the side-entry, adjustable ratcheting wrench assembly of FIG. 1, some parts being shown as cross-sectioned or as partially cross-sectioned
FIG. 2B is a fragmentary enlarged view of a teeth section of the handle of the wrench assembly.

The wrench 1 is adapted for use with a polygonal head bolt, in a preferred embodiment a dodecagonal head bolt 2. In using the wrench 1, the bolt 2 is first hand tightened into its threaded hole, or a like nut is hand tightened onto a threaded post or bolt. The side-entry, adjustable ratcheting wrench assembly 1 is held such that the consecutive grooves 41 of the worm gear 40 are engaged by the teeth 17 of the handle 10 to prevent movement of the worm gear 40 along its axis. The distance between the jaws 20, 30 is adjusted by rotating the worm gear 40 to facilitate side-entry presentation around the bolt head 2. The worm gear 40 is turned to bring the dynamic jaw 30 into contact with the bolt head 2, and the bolt head 2, in turn, into contact with the stationary jaw 20 such that two opposite corners of the bolt 2 are nested into the "V" notches 22, 32 of the two jaws. The bolt 2 may be turned by continuing to apply a torque force by way of forcing the handle 10 towards the direction of the dynamic jaw's side of the wrench assembly 1. Even if large forces are applied to the bolt 2, the wrench assembly 1 cannot slip sideways off of the bolt head 2 since the distance between the jaws 20, 30 is locked in place by the handle's teeth 17 meshing with the worm gear's consecutive grooves 41. Therefore, the bolt's corners are prevented by the "V" grooves 22, 32 in the jaws 20, 30 from making any lateral movement. FIG. 1 shows the buttress teeth 17 locking the worm gear 40 in place.

Figure 3:
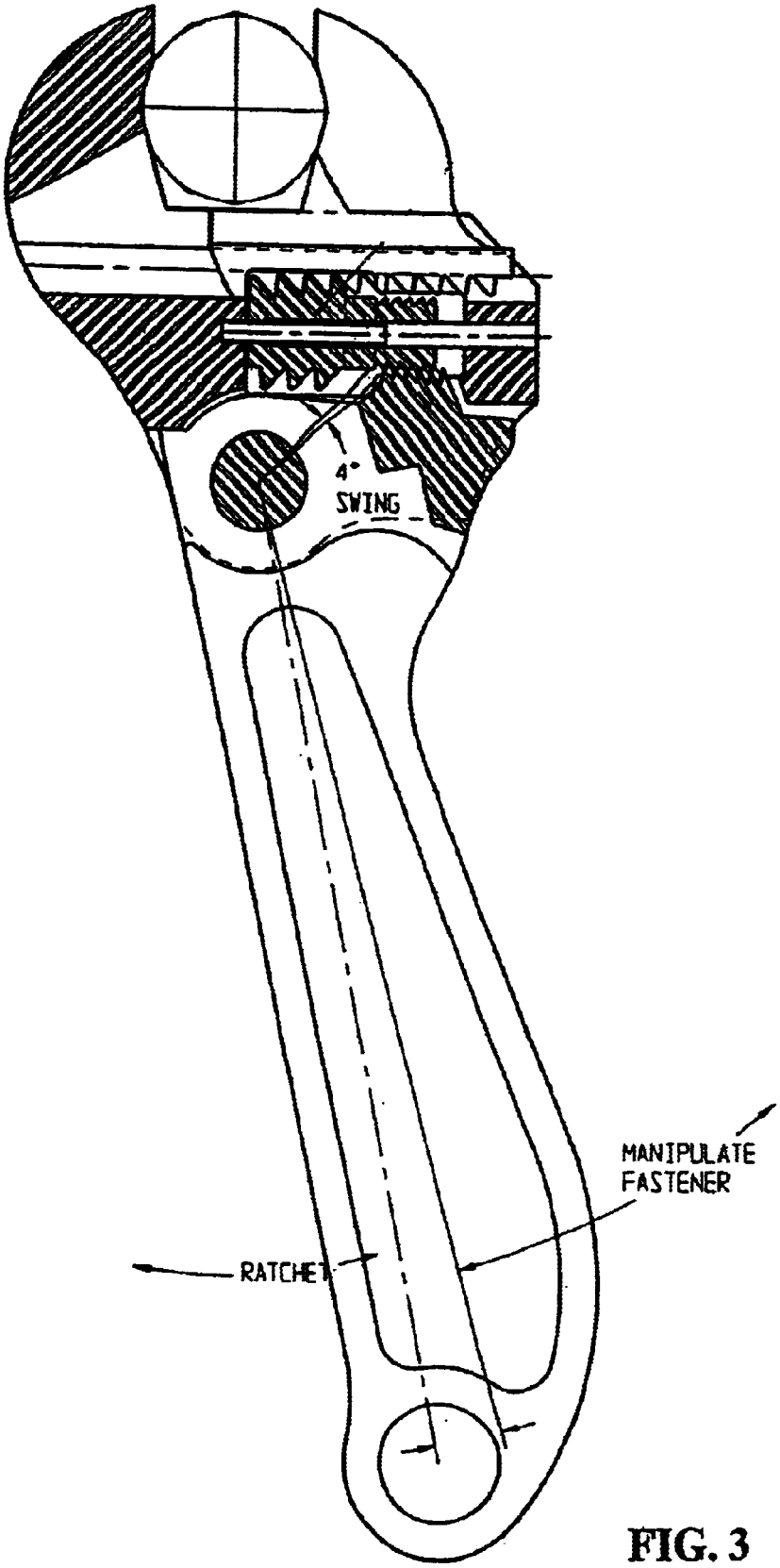
FIG. 3 is a face view of the wrench of FIG. 1, showing a dodecagonal bolt being secured in the jaws, where the handle has been rotated clock wise 4 degrees to disengage the consecutive grooves of the worm gear from the teeth of the handle.
Figure 4:
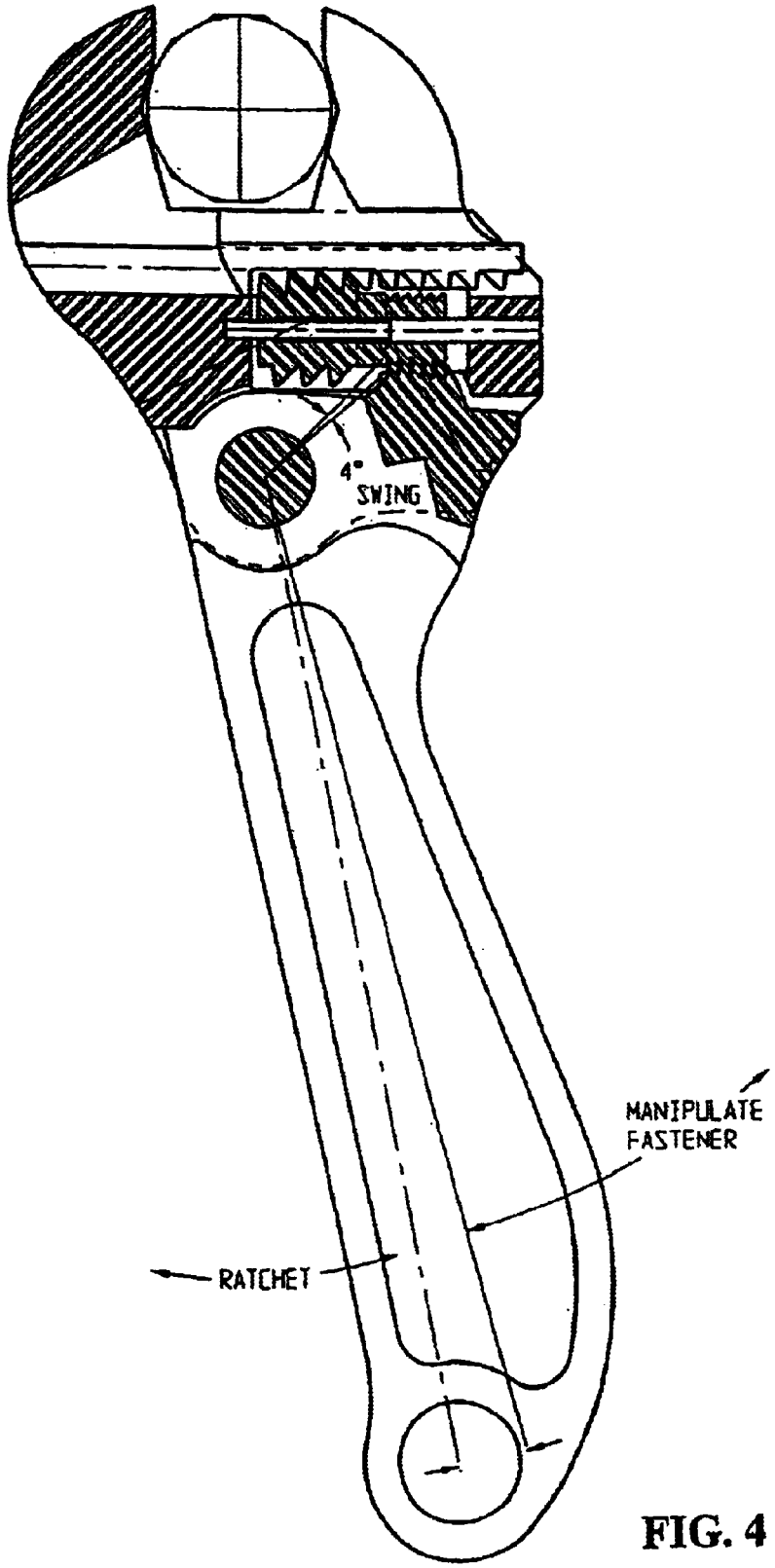
FIG. 4 is a face view of the wrench of FIG. 1, showing the teeth of the handle disengaged from the consecutive grooves of the worm gear, and the wrench assembly rotated 15 degrees around a dodecagonal head bolt which has not moved, where the dynamic jaw has been forced to open a bit further, carrying the worm gear back slightly on its axis pin.

When all of the available arc of action has been used up, and there is no room to turn the bolt 2 any further, a reverse force is applied to the handle 10. The handle 10 will first rotate approximately four degrees about the pivot 50 to disengage the teeth 17 of the handle 10 from the consecutive grooves 41 of the worm gear 40, whereupon further rotation of the handle 10 about the pivot 50 is prevented by a stop member provided by abutting surfaces of the handle and the stationary jaw to limit the rotation at a predetermined stop point. The worm gear 40 is now free to travel on its axis pin 60 with only the resistance being the pre-load force of the compression spring 61. FIG. 3 shows the series of buttress teeth 17 in a disengaged position that allows the worm gear 40 to slide along the rod 60, carrying the dynamic jaw 30 with it thereby enabling the wrench's ratcheting ability. The four degree position is maintained when the worm gear 40 is pulled against the pre-load force by means of a collar section 43 of the worm gear 40, where the collar section 43 makes contact with the teeth 17 of the handle 10 and prevents the handle 10 from rotating back beyond the four degree position. Further force in this direction will allow a force induced by the corners of the bolt 2 pushing against the faces of the "V" notches 22, 32 to push the dynamic jaw 30 away, on its key rail 37, from the stationary jaw 20 as the wrench assembly 1 rotates around the bolt head 2, the worm gear 40 being carried with the dynamic jaw 30. FIG. 4 shows the dynamic jaw 30 being opened to allow the wrench assembly 1 to rotate to a position fifteen degrees about the dodecagonal bolt 2, where a rotation of another fifteen degrees will set the bolt's corners back into the V notches 22, 32. Further turning of the wrench in the ratcheting direction continues to slip the dynamic head 30 off the bolt 2 for subsequent reseating of the jaws 20, 30 on the bolt 2. When the available ratcheting arc has again been attained, the force on the handle 10 is reversed again, and the wrench assembly 1 turns a small distance to again allow two corners of the bolt 2 to settle into the "V" notches 22, 32 of the two jaws 20, 30, and then allowing the teeth 17 of the handle 10 to re-engage the consecutive grooves 41 of the worm gear 40. The bolt 2 is again locked into position between the jaws 20, 30 and may be further tightened. The ratcheting action may be continued as often as is required.

To loosen the bolt 2, the wrench assembly 1 is simply removed from engagement, inverted, and re-engaged as was described above, and the ratcheting motion may be resumed to effect loosening the bolt 2. The ratchet index in the preferred embodiment is, for example, about 34 degrees, since there is 30 degrees of arc between consecutive corners of the bolt 2, plus the 4 degrees of arc required to engage or disengage the teeth 17 of the handle 10 and the consecutive grooves 41 of the worm gear 40.

Figure 5:
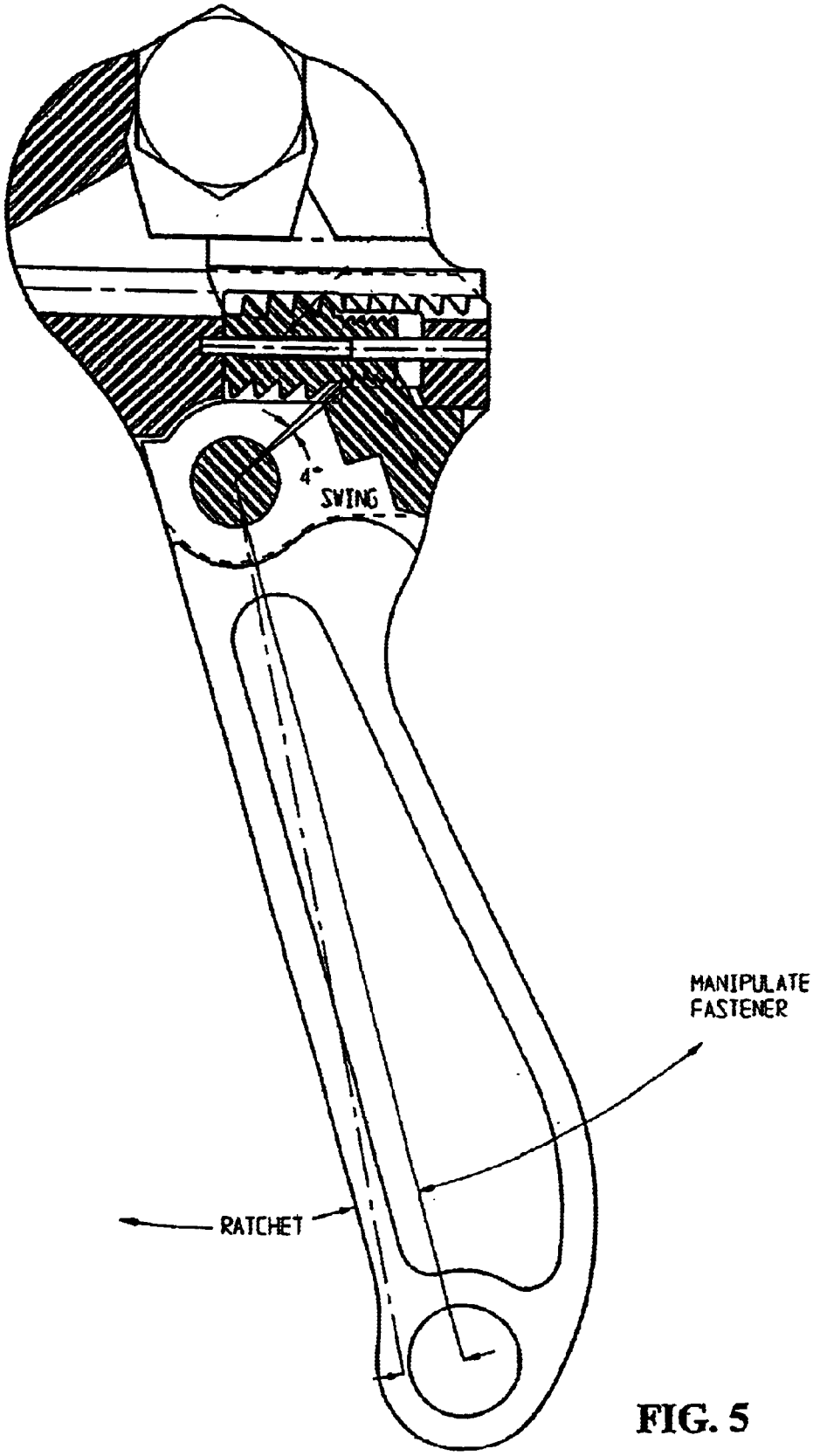
FIG. 5 is a face view of the wrench of FIG. 1, the view of the wrench showing the teeth of the handle in engagement with the consecutive grooves of the worm gear, locking the jaws in contact with a typical hexagonal head bolt.

In the case of a hexagonal head bolt, the present embodiment having 150 degree jaws 20, 30 is also capable of a ratcheting motion about a hex bolt as shown in FIG. 5, but there is no positive capture of the head within the "V" notches.

Figure 7:
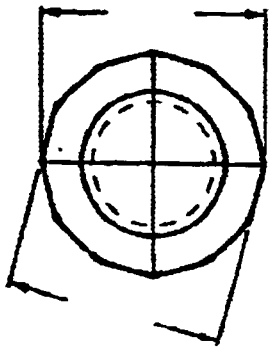
FIG. 7 shows an exemplary embodiment of dimensioning of a dodecagonal head ⅝"–11 bolt.
Figure 6A:
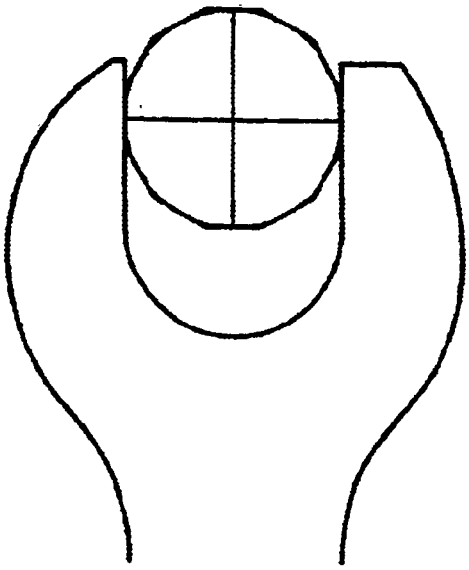
FIG. 6A shows an example of a dodecagonal head bolt being held by an open end wrench.
Figure 6B:
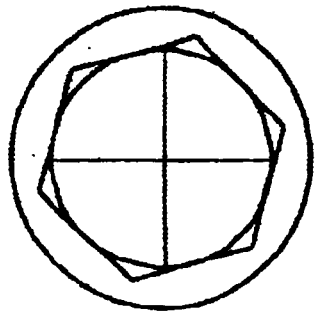
FIG. 6B shows an example of a dodecagonal head bolt being held by a socket head wrench.

The dodecagonal bolt 2 has been found to be especially well-suited for the ratcheting operation since there is less resistance to a reverse force on the handle 10 while still allowing a slip-free operation in the work direction. The bolt head 2 having a dodecagonal shape provides less overhang of the corner portions of the bolt head 2 compared with bolts having fewer faces, resulting in an improvement of transmittance of torque during tightening. As shown in FIG. 6A, the dodecagonal bolt head 2 may be captured by a standard open end wrench, or may be captured by a standard socket head wrench as shown in FIG. 6B. The dodecagonal bolt 2 in a preferred embodiment has a width between opposite flat surfaces of about 0.9375 inches and a width between opposite corners of about 0.9706 inches. These standard dimension locations are illustrated in FIG. 7.

An optimum side-entry, adjustable ratcheting wrench assembly for a hexagonal bolt requires that the jaw assembly be manufactured specifically for a hexagonal head bolt, in which case the ratchet index is about 64 degrees. FIGS. 8–12B illustrate an embodiment of the invention adapted to be used for hex head bolts and nuts. This exemplary embodiment also illustrates modifications to the handle and worm gear member.

In FIGS. 8–12B, a wrench 101 includes a handle 110, a main tool body 120 that acts as a pivoting stationary jaw, a dynamic jaw 130, a spring-loaded worm gear 140, and a pivot pin 150. In this embodiment, one or more shoulders, a pivot hole, and a series of buttress-thread profile teeth are provided in a handle 110 in a manner similar to the handle 10 as described above. In addition, the handle 110 has a tab 119 that engages the worm gear 140 when the worm gear 140 is engaged with the handle 110. Thus, as a result of the tab 119 being engaged with the worm gear 140, the consecutive grooves 141 of the worm gear 140 are prevented from disengaging from the projections 117 of the handle 110, for example, when an over-torque of the worm gear 140 occurs in adjusting the jaws 120, 130 for securing a bolt head 102.

The handle 110 has a pivot hole 115 that aligns with the pivot hole 125 of the main tool body 120 so that the pivot pin 150 connects the main body 120 to the handle 110 and allows the handle 110 to pivot in relation to the main tool body 120. The upper portion 113 having the series of buttress-thread profile teeth 117 forms an extension 118 roughly perpendicular to the length of the handle 110.

Figure 10:
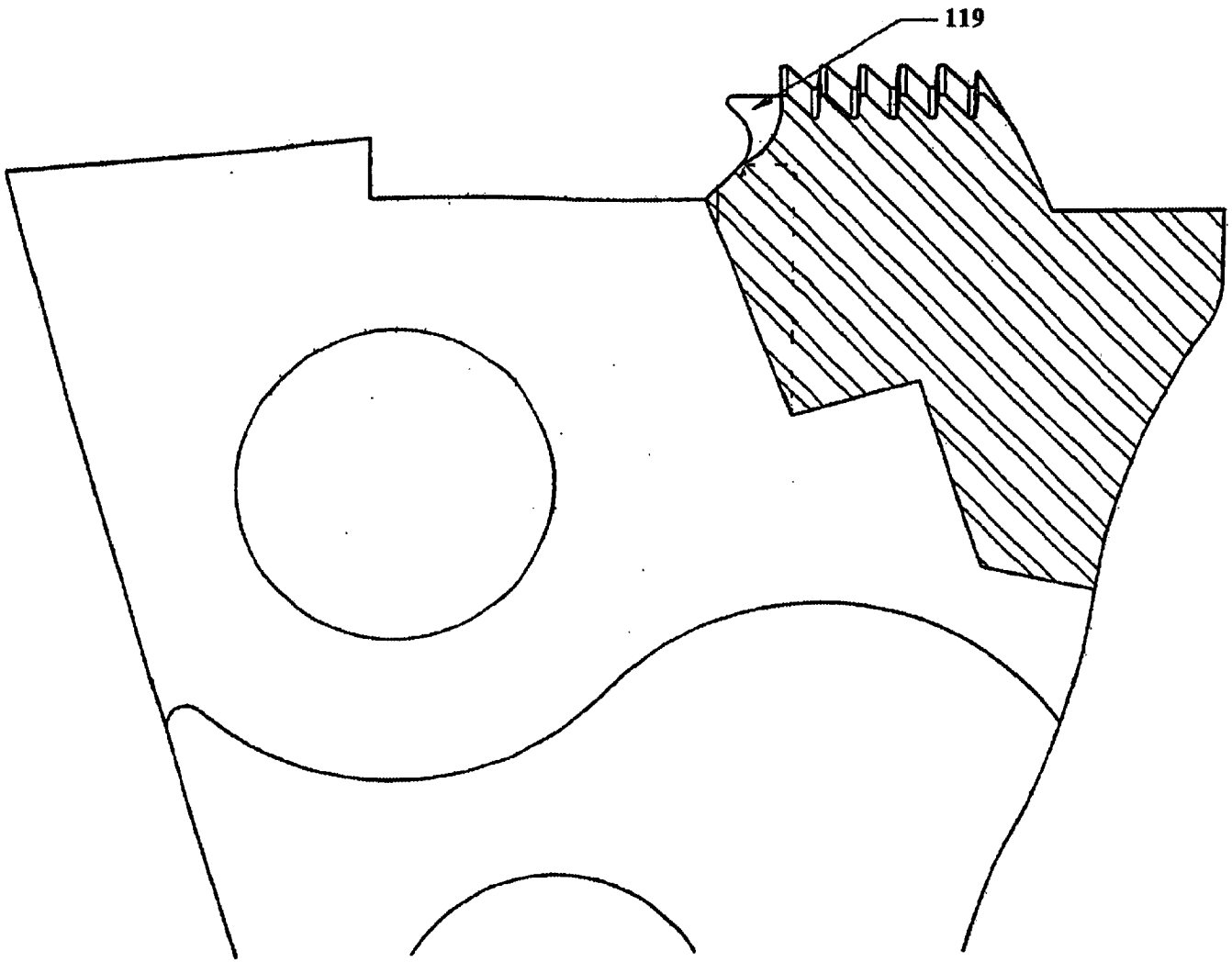
FIG. 10 shows a tab added adjacent the teeth of the handle to prevent the consecutive grooves of the worm gear from disengaging from the handle when an over-torque of the worm gear occurs in adjusting the wrench to secure a bolt head, in an exemplary embodiment of the present invention.

As shown in FIG. 10, the tab 119 is formed at a lateral end of the upper portion 113. The tab 119 in a preferred embodiment has a width that is less than a width of the teeth 117. The tab 119 is formed to allow the ratcheting action while also preventing a slipping of the jaws during a working action. The tab 119 may be formed to prevent the jaws from going to the four degree position when the worm gear 140 is over-tightened. Thereby, the tab 119 and annular groove 147 are structured so that engagement of the tab 119 with the annular groove 147 prevents disengagement of the concentric grooves 141 from the teeth 117. As shown in FIGS. 11A–B, the worm gear 140 has an annular groove 147 that is engaged by the tab 119. The annular groove 147 is formed in the collar section 143 of the worm gear 140. The curved surfaces of the tab 119 and groove 147 have a same or similar profile so that a mating or engaging of the tab 119 and the groove 147 is done with no obstruction.

As was described for the previous embodiment, the teeth 117 will either mesh with, or disengage from, a series of matching, consecutive grooves 141 formed as an addition to the modified worm gear 140, depending on the direction that the handle 110 is pivoted on the main body 120. The main tool body 120 is formed similar to the body 20, except that the jaw faces 123, 124 form a V notch having a dihedral angle of 120 degrees. A face 126 is formed at the bolt-entry end of the stationary jaw 120.

The dynamic jaw 130 is similar to the jaw 30 except that jaw faces 133, 134 form a "V" notch 132 that is a mirrored image of the "V" notch 122 in the stationary jaw. Therefore, the V notch 132 has a dihedral angle of 120 degrees. A face 136 is formed at the bolt-entry end of the dynamic jaw 130. The bottom of the dynamic jaw 130 has a section of consecutive projections 139 that maintain a constant pitch, as in the previously described embodiment.

As previously described, the worm gear assembly may be formed so that the urging force of a spring, if used, may be adjusted by a user so that a ratcheting action may be optimized by the user for a particular application. A release button (not shown) may be provided so that a user may reset or release a spring tension, either by changing the position of the spring member itself, or by lifting the worm gear 140 in order to disengage the worm gear 140 from the threads 117 of the handle 110. For the present embodiment, a release mechanism is adapted to be used with the tab 119 and annular groove 147, so that the worm gear 140 is free to move laterally against the spring force when the worm gear 140 is in a ratcheting position.

FIG. 8 shows the wrench 101 having the buttress teeth 117 locked in place with the consecutive grooves 141 of the worm gear 140 when a force is applied to the handle 110 in a work direction. The jaws of the wrench 101 are securing a hexagonal bolt 102. In FIG. 12, the buttress teeth 117 are disengaged to allow the worm gear 140 to slide laterally, carrying the dynamic jaw 130 with it, thereby enabling the ratcheting ability of the wrench 101 when force is applied to the handle 110 in the ratcheting direction. This ratcheting operation is shown in FIG. 13, where the dynamic jaw 130 has opened to allow the wrench assembly 101 to freely rotate thirty degrees about the hexagonal bolt 102. Rotating an additional thirty degrees will again set the bolt's corners back into the V notches 122, 132. FIGS. 14A–B show a front view and an end view of a wrench assembly 101, the end view illustrating how the upper section 113 of the handle 110 is engaged with the worm gear 140.

While the principles of the invention have been shown and described in connection with specific embodiments, it is to be understood that such embodiments are by way of example and are not limiting.

What is claimed is:

1. A side-entry, adjustable, ratcheting wrench comprising:

a first jaw member having an interior portion; a second jaw member slidingly engaged with the first jaw member;

a spool disposed in the interior portion of the a first jaw member, the spool having a worm along a first lengthwise outer portion and a series of essentially circular grooves along a second lengthwise outer portion, the worm for adjustment of the second jaw member;

a handle having a series of first projections; and a pivot connecting the first jaw member and the handle for pivoting between a working position and a ratcheting position, wherein the series of first projections engage with the series of essentially circular grooves when the wrench is at the working position and disengage from the series of essentially circular grooves when the wrench is at the ratcheting position.

2. The wrench of claim 1 wherein the second jaw member has a series of second projections engaged with the worm such that either of a lateral movement of the worm and a rotation of the worm causes a corresponding lateral movement of the second jaw member.

3. The wrench of claim 2 wherein the first jaw member includes a lateral guide slot for guiding a lateral movement of the second jaw member.

4. The wrench of claim 3 wherein the first and second jaw members respectively have opposing work surfaces that mirror one another, each of the work surfaces including two faces forming a V-shaped notch.

5. The wrench of claim 4 wherein the V-shaped notches each constitute a dihedral angle having an angular amount equal to 180 degrees minus the quantity 360 degrees divided by the number of circumferential surfaces of a polygonal bolt head to be secured by the wrench.

6. The wrench of claim 4 wherein the V-shaped notches each constitute a dihedral angle of about one hundred fifty degrees.

7. The wrench of claim 1 further comprising a rod for securing the spool to the first jaw member, wherein the spool is slidable along the rod.

8. The wrench of claim 7 further comprising an urging member for urging the spool to a position for mating of the essentially circular grooves with the first projections.

9. The wrench of claim 8 where the urging member has an adjustment mechanism for changing a force of the urging.

10. The wrench of claim 8 wherein the urging member includes a spring.

11. The wrench of claim 1 wherein the handle includes a tab extending laterally from the first projections in a direction towards the worm, and wherein the spool includes an annular groove disposed along the second lengthwise outer portion, the annular groove having a concave end facing the tab.

12. The wrench of claim 11 wherein the tab and annular groove are structured so that engagement of the tab with the annular groove prevents disengagement of the essentially circular grooves from the first projections.

13. The wrench of claim 11 wherein the tab and annular groove are structured so that engagement of the tab with the annular groove prevents the first jaw member from pivoting away from the handle when the worm is being tightened while the wrench is in the working position.

14. The wrench of claim 1 wherein, between the working position and the ratcheting position, one end of the first jaw member is pivotable away from one end of the handle by a predetermined angular amount.

15. The wrench of claim 14 wherein the predetermined angular amount is merely sufficient to allow the disengagement of the essentially circular grooves from the first projections.

16. The wrench of claim 1 wherein:

the handle includes a center portion formed at a distal end of the handle, the center portion being defined by at least one shoulder formed laterally across the handle, the shoulder having a portion with a radial curve and an other portion, the center portion including a first pivot hole disposed in a center of the radial curve, and wherein the first projections are formed in a distal end of the center portion;

the first jaw member has a first guide slot for receiving the center portion of the handle, a bottom surface with a shape aligned to a shape of the shoulder, a second pivot hole for being aligned with the first pivot hole, a first jaw surface with a first face and a second face, and a second guide slot disposed at least partly along an upper surface of the first jaw member;

and wherein the second jaw member has a second jaw surface with a third face and a fourth face that mirror the first and second faces of the first jaw surface, a bottom surface having a plurality of teeth formed therein, and a laterally extended portion for being slidingly disposed in the second guide slot.

17. The wrench of claim 16 further comprising a pin disposed in the first and second pivot holes, wherein:

the worm engages the teeth of the second jaw member, the wrench is structured so that lateral movement of the worm moves the second jaw member by engagement of the teeth;

the first jaw member is pivotable a predetermined angular amount away from the other portion of the shoulder when a force is applied to the handle in a ratchet direction;

and wherein the first jaw member is pivotable to abut the other portion of the shoulder when a force is applied to the handle in a work direction.

18. The wrench of claim 17, wherein the handle further includes a tab disposed adjacent the plurality of first projections, the spool includes an annular groove engageable with the tab, and wherein the tab and annular groove are structured so that engagement of the tab with the annular groove prevents at least one of disengagement of the essentially circular grooves from the first projections, the spool from pivoting away from the first projections unless a force is applied to the handle in a ratchet direction, and the first jaw member from pivoting away from the handle when the worm is being tightened while the wrench is in the working position.

19. The wrench of claim 16, further including an urging member structured to urge the spool to return to a position for mating the essentially circular grooves with the first projections.

20. The wrench of claim 19, wherein the urging member is disposed in the spool and includes a rod and a spring disposed about the rod, and wherein the spool is slidable along the rod when disengaged from the first projections.

21. The wrench of claim 19, wherein the urging member includes an adjustment mechanism for changing an urging force of the urging member.

22. The wrench of claim 16, wherein the first jaw surface has a fifth face, and wherein the second jaw surface has a sixth face that mirrors the fifth face.

23. The wrench of claim 22, wherein the fifth and sixth faces are each oriented normal to the second guide slot and are proximate an open end of the wrench.

24. The wrench of claim 16, wherein a first dihedral angle is formed between the first and second faces, a second dihedral angle is formed between the third and fourth faces, and wherein the first and second dihedral angles each have an angular amount equal to 180 degrees minus a quantity 360 degrees divided by the number of circumferential surfaces of a polygonal fastener head to be secured by the wrench.

25. A method comprising:

providing a side-entry, adjustable, ratcheting wrench having a handle with projections, a first jaw member, a second jaw member, and a spool having a worm along a first lengthwise outer portion and a series of essentially circular grooves along a second lengthwise outer portion, the first jaw member carrying the second jaw member and the spool and being pivotable between a first and second angular position, the second jaw member being moveable laterally with a rotation of the worm, the essentially circular grooves being engageable with the projections, the first and second jaw members each having V-notches that oppose one another;

turning the worm to bring the two V-notches into nested contact with a polygonal-head object;

applying force to the handle in a work direction to rotate the polygonal-head object in the work direction until a predetermined arc for the handle is exhausted;

applying force to the handle in a direction opposite the work direction until the handle pivots from the first angular position to the second angular position;

pushing one of the worm and the second jaw member laterally, thereby carrying the second jaw member away from the first jaw member; and applying additional force to the handle in the direction opposite the work direction.

26. A method comprising:

providing a side-entry, adjustable, ratcheting wrench having a handle with projections, a first jaw member, a second jaw member, and a spool having a worm along a first lengthwise outer portion and a series of essentially circular grooves along a second lengthwise outer portion, the first jaw member carrying the second jaw member and the spool and being pivotable between a first and second angular position, the second jaw member being moveable laterally with a rotation of the worm, the essentially circular grooves being alignable with the projections, the first and second jaw members each having V-notches that oppose one another;

turning the worm to bring the two V-notches into nested contact with a polygonal-head object;

applying force to the handle in a work direction to rotate the polygonal-head object in the work direction until a an available arc for the handle is exhausted;

applying force to the handle in a ratcheting direction opposite the work direction until the handle pivots from the first angular position to the second angular position, thereby disengaging the worm from the handle; and applying additional force to the handle in the ratcheting direction.

27. A method as claimed in claim 26 further comprising adjusting an urging force of a spring member against the worm to thereby adjust a resistance of the second jaw member to movement of the handle in the ratcheting direction.

* * * * *